United States Patent [19]

Bryson et al.

[11] 4,385,470

[45] May 31, 1983

[54] INSULATED POCKET WINDOW

[76] Inventors: Jeffrey C. Bryson, P.O. Box 28, Bayfield, Colo. 81122; Clayton J. Bryson, 431 8th St.; Robert C. Bryson, 2421 Columbine Dr., both of Durango, Colo. 81301

[21] Appl. No.: 132,337

[22] Filed: Mar. 20, 1980

[51] Int. Cl.[3] ..... E05B 65/04

[52] U.S. Cl. ..... 49/63; 49/372

[58] Field of Search ..... 49/63, 370, 372, 381; 160/37

[56] References Cited

U.S. PATENT DOCUMENTS

| | | | |
|---|---|---|---|
| 1,442,397 | 1/1923 | Gorrani | 49/370 |
| 1,983,846 | 12/1934 | Fuller | 160/37 |
| 2,925,859 | 2/1960 | Baker, Jr. | 49/372 X |
| 3,058,174 | 10/1962 | Sterling | 49/372 |
| 4,042,004 | 8/1977 | Kwan | 49/413 X |
| 4,115,953 | 9/1978 | Brosenius | 49/125 |
| 4,242,836 | 1/1981 | Anderson | 49/370 X |
| 4,267,666 | 5/1981 | Davidson | 49/372 X |

FOREIGN PATENT DOCUMENTS

| | | | |
|---|---|---|---|
| 789460 | 1/1958 | United Kingdom | 49/372 |

*Primary Examiner*—Kenneth Downey

*Attorney, Agent, or Firm*—Robert C. Dorr

[57] ABSTRACT

An insulated pocket window having a sliding insulating panel for completely closing off a viewing window. The sliding insulating panel is hidden from view between two stationary insulated panels, in one position, and in a second position, the insulating panel is slid along an insulated track to completely close off the viewing portion of the pocket window. The insulating panel is covered with two opposing metal sheets to provide security against breaking in.

2 Claims, 7 Drawing Figures

INSULATED POCKET WINDOW

BACKGROUND OF THE INVENTION

1. Field of the Invention

The present invention relates to windows and, in particular, relates to windows having means to provide positionable insulation barriers thereto.

2. Discussion of the Prior Art

The Inventors, prior to application for this Letters Patent, authorized a patentability search to be conducted. The following U.S. patents were uncovered in the search:

| Inventor | Patent No. | Date |
|---|---|---|
| Thompson | 2,931,578 | April 5, 1960 |
| Waldor | 3,012,294 | Dec. 12, 1961 |
| Angilletta | 3,960,135 | June 1, 1976 |
| Restle et al | 3,990,635 | Nov. 9, 1976 |
| French | 2,346,648 | Oct. 28, 1977 |

The 1976 patent issued to Angilletta sets forth a thermal barrier which can be selectively positioned in a window by opening and closing. The basic teaching of Angilletta, however, is that of a solar collector which traps solar heat and distributes it into the house through a plurality of slots 35.

The 1961 patent to Waldor also sets forth a positionable insulation mechanism which comprises a transparent cylindrical tube. A strip bisects the cylindrical tube and one side of strip is capable of absorbing solar radiation while the other side is capable of reflecting radiation or to be positioned to act as a window. In the position of reflecting solar radiation, the divider acts as an insulating panel.

The 1976 patent to Restle et al. also sets forth a positionable insulation member. Restle utilizes outer and inner sheets which are capable of trapping heat from sunlight. These sheets cooperate to reflect room heat away from the window to significantly reduce heat loss through the window from the interior of the house.

The 1960 patent issued to Thompson sets forth a retrofitable window adaptable to a double hung window. The Thompson approach basically discloses a solar heat collector delivering solar heated air into a house.

The 1975 French patent, discloses a screen for preventing heat radiation which can be mounted over windows to conserve heat.

The inventors are also aware of an article entitled "A Passive Solar Primary" by David Wright in which a door utilizing a positionable insulation panel is illustrated.

None of the above prior art patented approaches specifically set forth the teachings of the present invention as hereinafter set forth. Specifically, none of the prior art approaches disclose a rectangular sliding insulating panel which can be slid into a recessed pocket between two stationary insulating panels and in which the sliding panel has metal sides for security.

The present invention exhibits about eight times the insulating value of double pane windows and sixteen times that of a single pane. In one operation, the window of the present invention uses a single pane of glass since it admits about 12% more sunlight than a double pane of glass. Hence, in passive solar operation more heat enters the house through a single pane and the insulating panel when closed over the single pane of glass emulates the R-insulation value of the wall and prevents the heat from being lost.

OBJECTS OF THE INVENTION

It is an object of the present invention to provide a new and improved positionable insulation panel for a viewing window.

It is another object of the present invention to provide new and improved security for positionable insulation panels.

These and other objects of the present invention are set forth in the following specification.

SUMMARY OF THE INVENTION

An insulated integral window unit having a first viewing section and a second hidden pocket section containing a sliding insulating panel which is capable of sliding between the viewing section and the pocket section.

The viewing section contains a rectangular frame in which can be operatively mounted one or a plurality of plates of glass. A track is formed in the first rectangular frame and communicates with the pocket section. The width of the first rectangular frame is substantially equal to the width of the wall including the exterior siding and the interior finish material.

The second section also has a rectangular frame having substantially the same vertical and horizontal dimensions as the frame of the viewing section, but having a thickness which is substantially equal to the thickness of the wall less the thickness of the exterior and interior finishing material. Also disclosed in the second rectangular frame is a track which is integral with the track in viewing section. Disposed on either side of the track in the hidden pocket section are a pair of insulating panels.

The sliding insulating panel engages the track and is capable of sliding between the viewing and pocket sections. On either side of the insulating panels are sheets of metal to provide security for the window.

When the insulating panel is slid over the window, the R-insulation value of the viewing section and the hidden pocket section are substantially the same as the wall.

DETAILED SPECIFICATION

Figure 1:
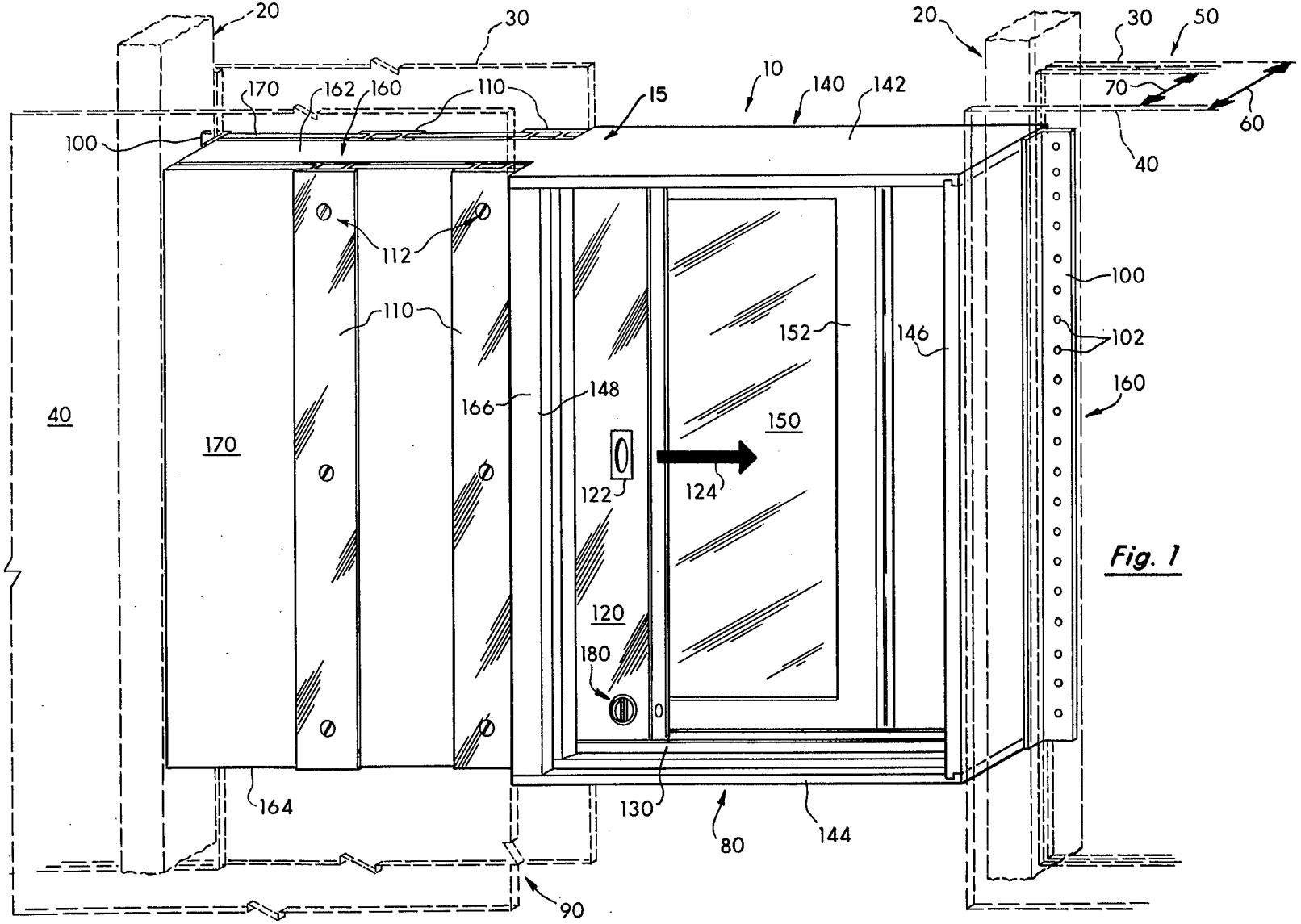
FIG. 1 is an illustration of the window unit of the present invention mounted between two studs in a wall.

In FIG. 1 the insulated window unit of the present invention 10 is shown mounted between two wall studs 20. The wall studs 20 together with the exterior siding 30 and the interior finish material 40 such as dry wall generally comprise a wall 50 having a thickness designated by arrow 60. The thickness of the stud 20 is designated by arrow 70 and is generally the thickness of the wall 50 less the thickness of the siding 30 and of the finish material 40. Of course, in conventional wall construction, additional materials, not shown, may be utilized such as vapor barriers.

A window unit 10 of the present invention generally includes an integral frame unit 15 having two sections—a viewing section 80 and a hidden insulated pocket section 90. As can be seen by inspection of FIG. 1, the viewing section 80 has a thickness which is generally the thickness 60 of the wall 50 whereas the hidden insulated pocket section 90 has a thickness which is generally the thickness of the stud 70. The reason for this is that the pocket section 90 will have the interior finish material 40 and the exterior siding 30 affixed to either side of it. Hence, when installed in wall 50, the user of the window unit 10 of the present invention only sees the viewing section 80.

The entire unit 10 is integral and is connected to the wall studs 20 by means of nailing fins 100. These nailing fins 100 firmly secure, by means of a plurality of nails 102, the opposing vertical and horizontal ends of the unit 10 to the studs 20. Once the unit 10 is mounted between the studs 20, the exterior siding 30 and the finish material 40 can be affixed into the metal studs 110 located on the sides of the pocket section 90. Screws may be used and are generally designated 112 in the drawing. Hence, when mounted, the window unit 10 is supported by the studs 20 on the opposing horizontal and vertical ends and by siding 30 and finish material 40. When fully assembled, the unit is designed such that the viewing sections 80 are substantially flush with the wall 50 containing siding 30 and finish material 40.

A panel, composed of insulation, 120 is capable of sliding in the direction of arrow 124 along track 130. The track 130 is made of material which substantially prevents heat transfer from the exterior of said building to the interior. The panel 120 is capable of sliding in track 130 to completely close off the viewing section 80. When this occurs, significant insulation is provided to the viewing section 80 of the window unit 10. In this configuration, the window unit of the present invention typically provides eight times the insulating value of double pane windows and sixteen times the insulating value of single pane windows. In typical environments, the window unit 10 of the present invention with the sliding panels closed attains an insulating value of R16 the same insulating value as the average insulated exterior wall 50.

Additional advantages in using the sliding panel 120 relate to security, to sound privacy, and to light protection. For example, the present invention could be used in motels to provide not only insulation, but sound and light privacy. In hospital environments, the need for curtains and the associated replacement and cleaning costs can be eliminated through use of the present invention. In school environments, the windows of the present invention can be utilized to provide a dark room for audio visual use as well as the thermal insulation properties.

It can be observed that when the window 10 is used in passive solar construction and is oriented to face south, the heat collected through the window 10 during the day is not lost at night. In other words, during the day the insulating panel 120 resides in the insulated pocket section 90 to permit the entry of solar energy. At night, however, the insulating panel 120 is closed thereby preventing the loss of substantial heat through the window. A handle 122 is provided to aid in the sliding of panel 120.

Figure 2:
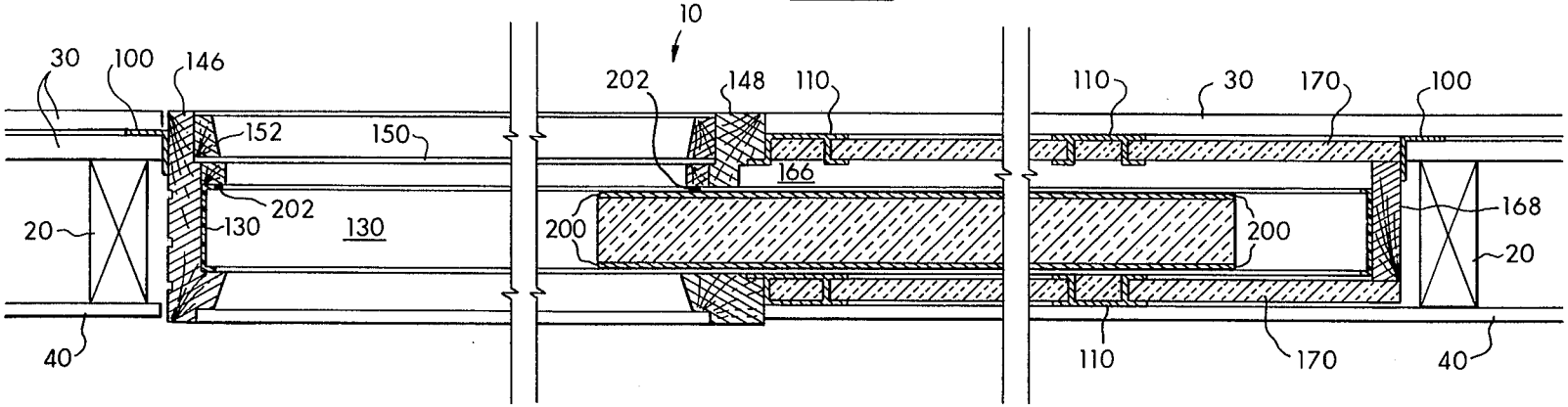
FIG. 2 is a top cross sectional view of a picture window incorporating the teachings of the present invention.
Figure 5:
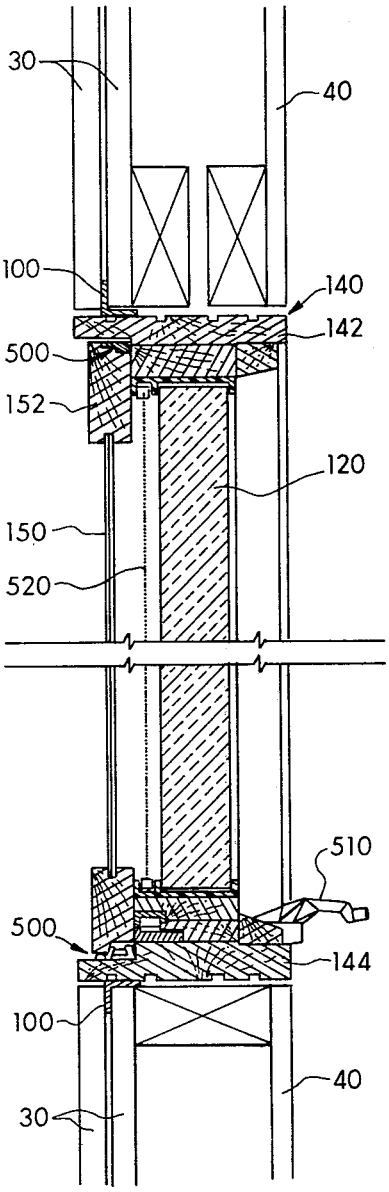
FIG. 5 is a cross sectional view of a casement window incorporating the teachings of the present invention.
Figure 3:
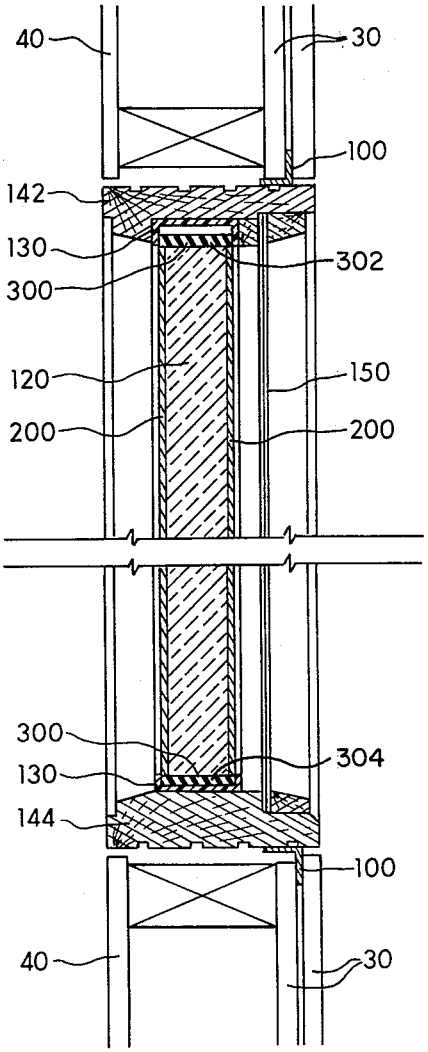
FIG. 3 is a side cross sectional view of the picture window of FIG. 2.

The viewing section 80 of the window unit 10 includes a frame 140 having an upper horizontal end 142, a lower horizontal end 144, and two opposing vertical ends 146 and 148. A plate or plates of glass 150 conventionally engaging a frame 152 is disposed in the rectangular frame 140. The glass frame 152 can engage rectangular frame 140 in a variety of manners including sliding (as shown in FIG. 1); by cranking to release the frame 152 from frame 140 (casement style as shown in FIG. 5); or by permanently affixing frame 152 into frame 140 (picture window style as shown in FIGS. 2 and 3). All of these approaches are conventional and are well known. Furthermore, the present invention can be adopted to other conventional windows such as awning style.

The insulated pocket section 90 also has a rectangular frame 160 configuration having an upper horizontal end 162, a lower horizontal end 164, and two opposing ends 166 and 168. On the sides of frame 160, however, are a pair of insulating panels 170. Between the pair of insulated panels 170 is mounted the insulating track 130, not shown in FIG. 1, on which the sliding panel 120 slides. Embedded in each insulating panel 170 are a pair of metal studs 110. This presents a preferred approach and it is clear that modification could be made such as using only one stationary insulating panel.

FIG. 2 is a horizontal cross section of a picture window incorporating the concepts of the present invention. The unit 10 is mounted to opposing studs 20 by means of the nailing fins 100 only on the exterior side.

The sliding insulating panel 120 slides in track 130 from one end to the other. Insulating panel is preferably 1¾" thick and is constructed from two pound density urethane. The sliding panel 120 effectively insulates against winter heat loss and summer heat gain. When closed against side 146, it minimizes exterior noise and provides substantial security. Security is provided by two opposing steel panels 200 firmly bonded to the sliding panel 120 on opposing sides thereof. The surface 200 is preferably made from 26 gauge steel and is preferably textured. Weather stripping beads 202 are provided to inhibit air infiltration along the engagement of the sliding panel 120 with the pocket section 90.

As observed in FIG. 3, the opposing steel coverings 200 are capped off at opposite vertical ends (302, 304) by means of a poly vinyl chloride (PVC) cap 300. The PVC cap is bonded to the sliding panel 120 and substantially prevents any heat transfer caused by the steel panels 200. The PVC cap 300 also allows easy movement and provides an air tight seal with the track 130 which is also made from PVC. Hence, an air tight seal is formed between the PVC cap and the PVC cap in the head (end 142) and the sill (end 144) of the window.

The metal studs 110 are preferably ¾" metal studs and plates of urethane insulation 170 are firmly bonded thereto in the configuration shown. In operation, the installer screws the interior dry wall 40 and the exterior siding 30 to the metal studs 110 with power driven, self tapping metal screws.

In the preferred embodiment shown in FIGS. 2 and 3, the following insulation values are observed as being typical:

| 'EMPTY' POCKET | |
|---|---|
| ¾" Urethane | R6 |
| 1" Urethane | R8 |
| ½" Wood Siding | R0.62 |
| ½" Drywall | R0.45 |
| Still Air-Interior | R0.68 |
| Pocket Air Space | R0.58 |
| TOTAL R VALUE | R16.33 |

| PANEL/GLASS | |
|---|---|
| 1¾" Urethane | R14 |
| 1 Lite Glass | R0.89 |
| Still Air-Glass | R0.68 |
| Still Air-Panel | R0.68 |
| TOTAL R VALUE | R16.25 |

The rectangular frames 140 and 160 are preferably made from wood.

Figure 4:
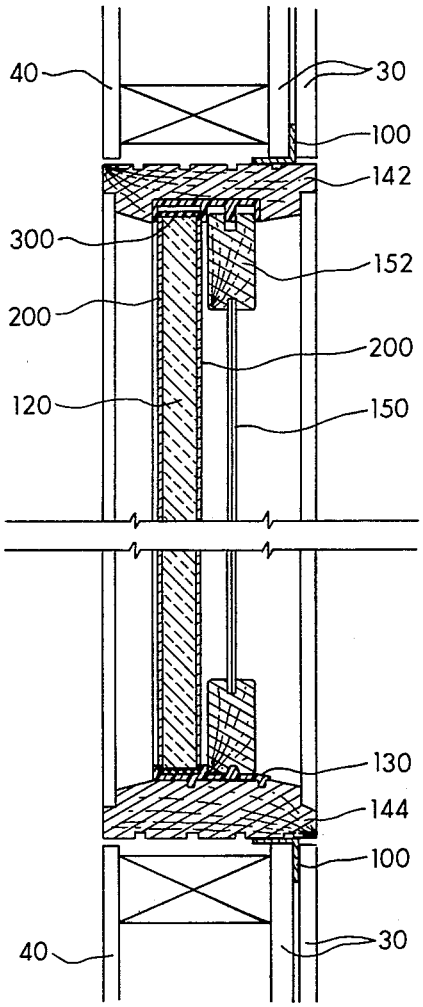
FIG. 4 is a side cross sectional view of a slider window incorporating the teachings of the present invention.

In FIG. 4 is shown the cut away side view of the window 10 in the glass-slider configuration of FIG. 1. In this configuration, the glass 150 has a frame 152 which is configured to move in the vinyl track 130. In this fashion, it can be readily observed, that both the sliding insulating panel 120 and the glass 150 can be slid in track 130 so that both the panel 120 and the window can be opened. In all other aspects, the configuration is the same as that shown in FIGS. 2 and 3.

A casement window embodying the teachings of the present invention is shown in FIG. 5. In this configuration, the glass 150 in its frame 152 engages the overall frame 140 in a pivotal relationship about point 500. A conventional crank 510 is utilized to pivot the window 150 about points 500. To insure against air infiltration, the casement window shown in FIG. 5 uses a rigid PVC baffle and weather stripping. A screen 520 can also be provided.

Figure 6:
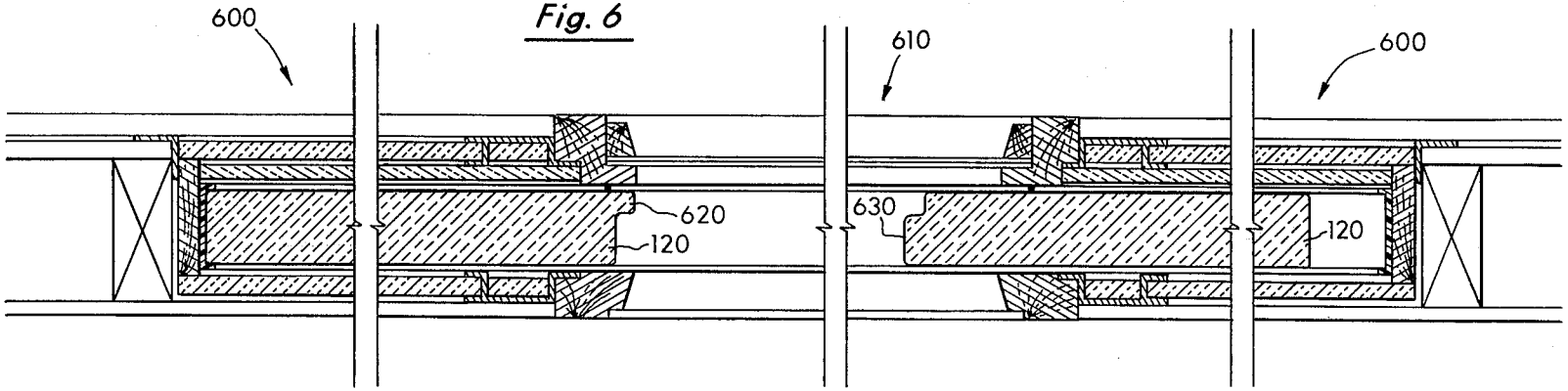
FIG. 6 is a top cross sectional view of a picture window incorporating the teachings of the present invention for a second embodiment.
Figure 7:
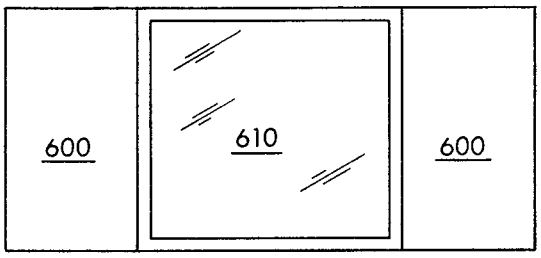
FIG. 7 is an illustration of the picture window shown in FIG. 6.

In FIG. 6, another embodiment of the present invention is shown to include two opposing half pockets 600 about a viewing portion 610. The sliding panels have notched edges 620 and 630 which mate to provide an offset air seal. This type of embodiment would be suitable, for example, in picture windows as shown in FIG. 7.

While preferred forms of the present invention have been set forth in the drawing, it is to be expressly understood that modifications and changes may be made to the structure, yet still be under the teachings of the present invention as set forth in the claims.

We claim:

1. An improved prefabricated window unit (10) having a viewing section (80) and a pocket section (90) containing an insulating sliding panel (120) disposed therein for mounting, as an integral structure, between the studs (20) of a wall (50) in a building and for receiving the exterior siding (30) and interior finish material (40) of said building so that when said window unit (10) is mounted said pocket section (90) is hidden from view being disposed between said exterior siding (30) and said interior finish material (40), said wall (50) of said building being insulated to a predetermined R value, said improved prefabricated window unit (10) comprising:

an integral frame unit (15) comprising:

(a) an upper frame member (142, 162);

(b) a lower frame member (144, 164) parallel to said upper frame member (142, 162);

(c) a first end member (146);

(d) a second end member (168), said first and second end members (146, 168) being parallel to each other and for fixedly holding said upper (142, 162) and lower (144, 164) frame members apart at the opposing ends of said upper (142, 162) and lower (144, 164) frame members, and (e) two opposing members (166) in parallel spaced relationship fixedly connected between said upper frame member (142, 162) and said lower frame member (144, 164) for equally dividing said integral frame unit into said viewing section (80) and into said pocket section (90), said viewing section (80) having a thickness (60) substantially equal to the thickness of said wall and being formed around its periphery by a first portion (142) said upper frame member (142, 162), said first end member (146), a first portion (144) of said lower frame member (144, 164), and said opposing members (166), said pocket section (90) having a thickness (70) substantially equal to the thickness of the studs (70) and being formed around its periphery by said second portion (162) of said upper frame member (142, 162), said opposing members (166), a second portion (164) of said lower frame member (144, 164), and said second end member (168), a pair of opposing insulating panels (170), in parallel spaced relationship to each other, affixed to the opposing sides of said periphery of said pocket section, the combined insulating R value through said pair of insulating panels being substantially equal to said predetermined R value, at least one pair of opposing finishing studs (110) in parallel spaced relationship affixed between said second portion (162) of said upper frame member (142, 162) and said second portion (164) of said lower frame member (144, 164) and embedded in said opposing insulating panels (170) so that when said integral frame unit is mounted between said studs (20) said exterior siding (30) and said interior finish material (40) can be affixed to the aforesaid finishing studs (10) thereby hiding said pocket section (90) from view, the combined thickness of said affixed interior finish material (40), said opposing insulating panels with said embedded finishing studs (110) mounted on said integral frame unit, and said exterior siding (30) being substantially equal to the thickness of said wall, means (100) affixed to the outersurfaces of said first and second end members (146, 168) for mounting to said studs (20) of said wall (50) so that said integral frame unit can be firmly mounted between said studs (20), a track (130) affixed to the entire inner periphery of said integral frame unit between opposing members (166), said opposing insulating panels (170) and said opposing finishing studs (110), said track (130) being made from material which substantially prevents heat transfer from the exterior of said building to the interior of said building, a panel (120) disposed in said track (130) between said upper frame member (142, 162) and said lower frame member (144, 164), said panel (120) being capable of sliding between said viewing section (80) and said pocket section (90) from an open position where said panel (120) is fully disposed in said pocket section (90) to a closed position where said panel (120) fully covers said viewing section (80), said panel (120) being made of insulating materials that have a combined R value of insulation substantially equal to said predetermined R value when said panel (120) is in said closed position, weather stripping means (20) on said two opposing members (166) for inhibiting air infiltration between said two opposing members and said panel (120) whether said panel is in said closed position, said open position, or in transit therebetween, and a window (150, 152) mounted in said viewing section (80) of said integral frame unit.

2. The improved prefabricated window unit (10) further comprising:

a pair of metal panels (200) bonded to opposing sides of said sliding panel (120), and a pair of caps (300) provided on the opposite vertical ends (302, 304) of said sliding panel, said caps being made from material which substantially prevents heat transfer between said metal panels (200), said caps (300) engaging said track (130) to provide an air tight seal when said sliding panel (120) is in said open and closed positions.

* * * * *